US007077238B2

(12) United States Patent
Butler et al.

(10) Patent No.: US 7,077,238 B2
(45) Date of Patent: Jul. 18, 2006

(54) LADDER CADDY

(76) Inventors: David C. Butler, P.O. Box 2195, Fairfield, IA (US) 62556; Clint L. Dixon, 7427 176th Ave. West, Box 241, Reynolds, IL (US) 61279

( * ) Notice: Subject to any disclaimer, the term of this patent is extended or adjusted under 35 U.S.C. 154(b) by 91 days.

(21) Appl. No.: 10/893,805

(22) Filed: Jul. 17, 2004

(65) Prior Publication Data

US 2005/0056486 A1 Mar. 17, 2005

Related U.S. Application Data

(60) Provisional application No. 60/503,095, filed on Sep. 13, 2003.

(51) Int. Cl.
*E04G 1/00* (2006.01)
*E04G 3/00* (2006.01)
*E06C 7/16* (2006.01)

(52) U.S. Cl. ..... 182/129; 182/121; 248/210; 248/238; 206/373

(58) Field of Classification Search ..... 182/129, 182/121, 214, 107, 230, 122; 248/210, 211, 248/235, 238; 206/372, 373
See application file for complete search history.

(56) References Cited

U.S. PATENT DOCUMENTS 3,642,240 A * 2/1972 Hershey ..... 248/210
4,120,472 A 10/1978 Balne
4,359,138 A * 11/1982 Kummerlin et al. ..... 182/214
4,480,810 A 11/1984 Hall
4,624,430 A 11/1986 Ehmke
4,653,608 A 3/1987 Casada
4,899,970 A * 2/1990 Berzina ..... 248/210
5,052,581 A * 10/1991 Christ et al. ..... 182/121
5,106,045 A 4/1992 Bezotte
5,191,954 A * 3/1993 Ledford ..... 182/129
5,275,256 A 1/1994 Ellzey
5,370,263 A 12/1994 Brown
D357,119 S 4/1995 Calmeise et al.
5,421,428 A * 6/1995 Ingles ..... 182/129
5,429,205 A * 7/1995 Collins ..... 182/122
D361,664 S 8/1995 Brown
5,460,241 A * 10/1995 LaBelle ..... 182/214
5,542,553 A 8/1996 Penniman
5,622,278 A 4/1997 Fries et al.
5,649,682 A 7/1997 Martin
5,967,259 A 10/1999 Williams
6,098,748 A * 8/2000 Harper et al. ..... 182/129
6,105,911 A 8/2000 Olexson
6,848,540 B1 * 2/2005 Kvam ..... 182/129

* cited by examiner

*Primary Examiner*—Hugh B. Thompson, II
(74) *Attorney, Agent, or Firm*—Law Office of Joel D. Voelzke

(57) ABSTRACT

A ladder caddy for holding tools, small parts, and the like for a workman on a ladder includes four curved cradles for holding the caddy to the ladder, two of the cradles holding consecutive and respective rungs of the ladder when the caddy is mounted in a first position, and two of the cradles holding consecutive and respective rungs of the ladder when the caddy is mounted in a second position inverted and upside down from the first position. The caddy includes a tool holding structure extending outwardly from the ladder at an angle of approximately 15 degrees offset from perpendicular so that when the caddy is mounted on a leaning ladder the structure extends approximately horizontally. The caddy includes a clamp for clamping to the ladder, integrally formed tool holders, and a variety of accessories that mate with the caddy body.

11 Claims, 5 Drawing Sheets

LADDER CADDY

CROSS-REFERENCE TO RELATED APPLICATIONS

This application claims priority from provisional application 60/503,095, filed Sep. 13, 2003.

BACKGROUND OF THE INVENTION

1. Field of the Invention

This invention relates to the field of ladder accessories. More particularly, this invention relates to the field of a ladder caddy for holding tools and similar equipment.

2. Description of Related Art

A workman at any job site often needs to have a significant number of tools within easy reach. This is true whether the job site is at ground level, or is elevated off the ground such that the workman must perform the work while standing on a ladder. Being on a ladder creates a particular need to have many tools easily accessible, due to the difficulty of retrieving additional tools from a truck or other area if necessary. Thus, it is important for a workman to have an effective ladder caddy for firmly holding a significant number of tools, and organizing and presenting those tools in an ergonomic, efficient, and timely manner.

A number of tool caddies have been proposed in the past. U.S. Pat. Nos. 6,105,911 5,649,682, and 4,624,430 disclose apparatuses for holding paint cans and/or paint brushes. U.S. Pat. No. 5,622,278 discloses a box similar to a tool chest that is mounted to a ladder, with loops on the outside of the box for holding a hammer, a power drill, and the like. U.S. Pat. Nos. 5,542,553 discloses a ladder caddy that is similar to a tool belt, and which is mounted to a step ladder. U.S. Pat. No. 4,480,810 discloses a ladder caddy having a box like structure and slotted plates for holding tools, which can be tightened to a ladder rung via a wing nut. None of these devices, however, represents a completely satisfactory solution.

INVENTION SUMMARY

The present invention provides an extremely versatile and easy to use tool caddy for use on an extension ladder. A base section hooks and attaches to consecutive rungs of an extension ladder at two separate attachments points defining generally concave mounting cradles. A built in clamping mechanism allows the base to be firmly clamped to a ladder rung. The base is generally L-shaped, with the horizontal tool holding portion of the L extending outwardly from the plane of the ladder to which the base is mounted. The base has a total of four mounting cradles grouped into two pairs. Each pair is positioned to oppose the other, allowing the base to be easily inverted and mounted to a ladder with the outwardly extending horizontal tool holding portion positioned either near the top of the base, or near the bottom of the base, and positioned either toward or away from the user. The horizontal tool holding leg of the L is angled from perpendicular to the mounting cradle pairs in order to accommodate the standard recommended ladder lean angle of 15°, such that when mounted on a ladder leaning at 15° from vertical, the outwardly extending tool holding portion of the base extends generally level and horizontal. The base includes a number of holes, slots, and apertures for holding various tools, and can accept a number of accessories including cups, trays, a roll holder, and a winged bar. The removable winged bar, when attached, acts as a combination D-handled power/air tool holder, coiled cord holder, and retaining device for holding pipe, conduit, and other similar materials. The entire base is formed in such a way that it provides support in the tray and cradle areas to hold the weight of a wide variety of tools and materials and provides strength for the base to stay attached to the rungs of the ladder. The base is easily removed and reattached to the ladder. The overall width of the base is preferably such that the base will attach to any industry standard ladder with clearance to either side between the base and the main upright rails of the ladder.

Exemplary embodiments of the invention will be further described below with reference to the drawings, in which like numbers refer to like parts.

DETAILED DESCRIPTION OF THE PREFERRED EMBODIMENTS

Figure 1:
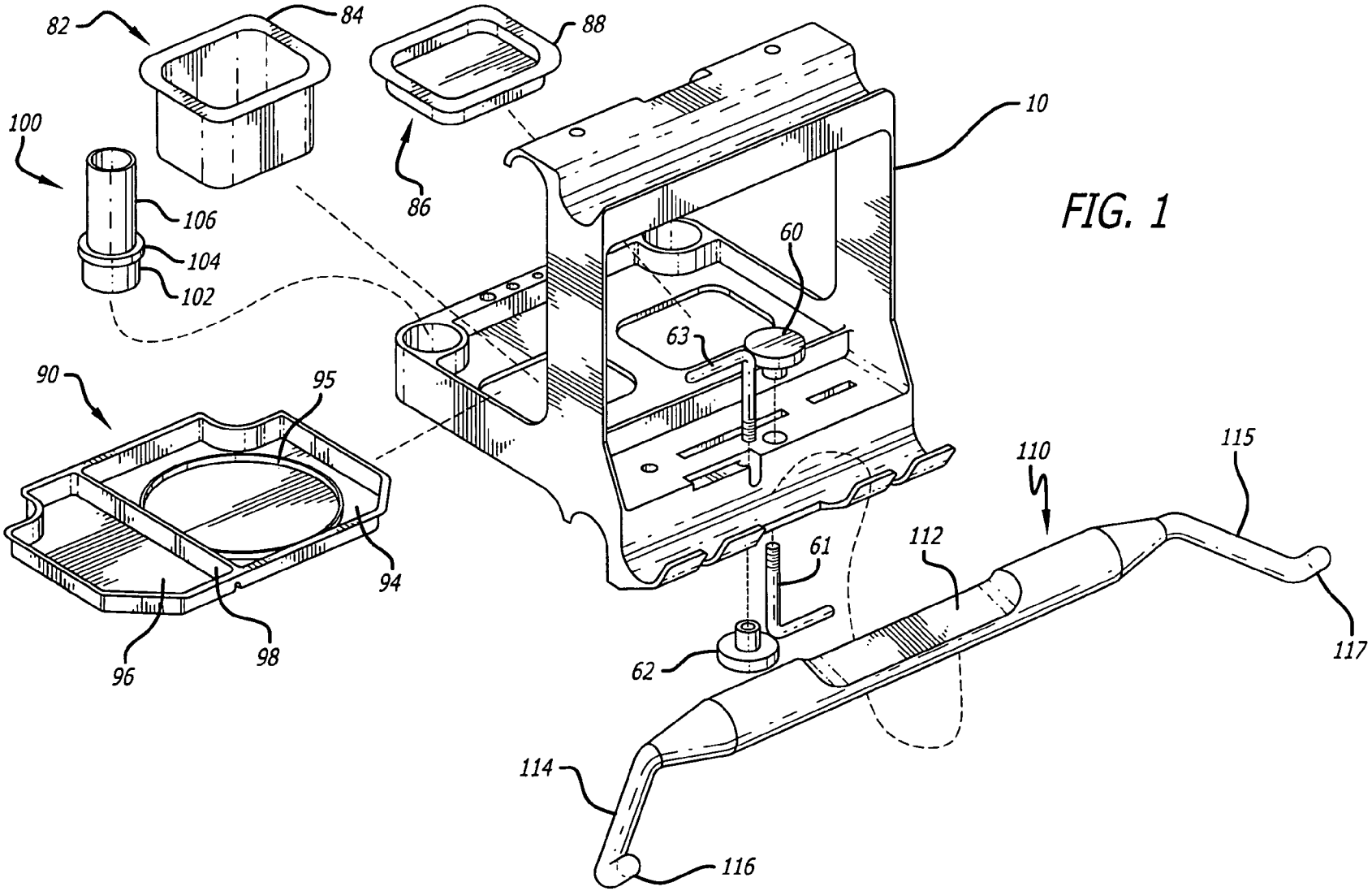
FIG. 1 is an exploded view showing the ladder caddy according to an illustrative embodiment of the present invention.

FIG. 1 is an exploded view showing the ladder caddy according to one illustrative embodiment of the present invention. The ladder caddy includes a base 10 and several accessories including a first cup 82 for holding small parts or tools. Cup 82, in a modified version, is also available with a partially hollow bottom, (round cut-out), to accommodate a standard drill chuck with attached drill bit, enabling the cup to act as a drill holder. Also included is a second shallower cup 86 for holding small parts or tools, a combination liner tray 90 for holding a paint can and paint brush, a roll holder 100 for holding rolled paper towels, masking paper, rolls of tape, or narrow tools, and a winged bar 110 for holding coiled cords, D-handled power/air tools, and also used as a piping/conduit holder. Base 10 is preferably formed of a strong yet lightweight material such as plastic, fiberglass, or lightweight metal alloy. If the base is formed of metal, it can be coated with a non-conductive coating such as rubber for safety.

First and second cups 82 and 86 have respective lips 84 and 88 so that the cups can be held within apertures 38 and 40 (FIG. 2) in the base 10. Liner tray 90 includes a recessed paint can section 94 having a raised circular ridge 95 for holding a standard one gallon can of paint up and off of the bottom surface and away from spilled liquids, a recessed brush section 96 for holding a wet paint brush, and a divider 98 between the paint can section and the brush section. Liner tray 90 can be made of either a lightweight material such as plastic for disposability, or can be made of a heavier and thicker material so that the tray can be cleaned and reused. Liner tray 90 can hold other items as well as a paint can and brush. Liner tray 90 can also be designed with a center ratcheting area of opposing male and female teeth molded into the liner tray 90 and the horizontal tool holding area of base 10, allowing the liner tray 90 to be adjusted by a few degrees to provide a level surface for paint or other liquids. Adjustable stops can be added to lock the adjustable liner tray 90 into place.

Figure 2:
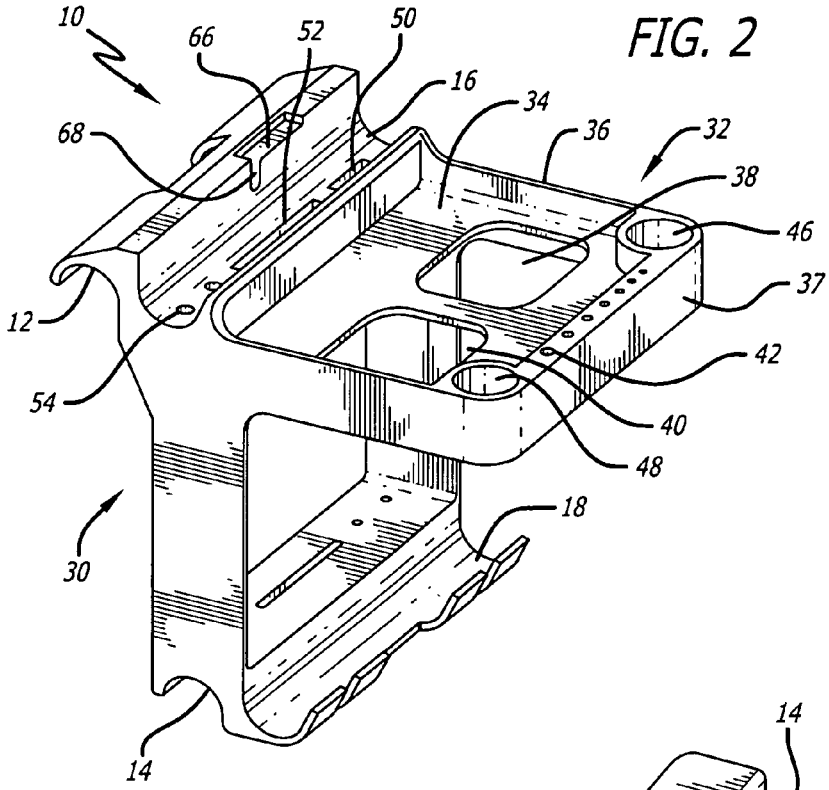
FIG. 2 is a perspective view showing the base of the ladder caddy of FIG. 1. inverted from its position shown in FIG. 1.

Roll holder 100 fits into at least one of the circular holes 46 or 48 illustrated in FIG. 2 at the corners of the base 10. Roll holder 100 includes a cylindrical base section 102 to mate with hole 46 or 48, a stop ridge 104, and an elongated, cylindrical roll holding section 106 for holding a roll of paper towels, a roll of masking paper, or the like. Roll holder 100 can also be used to hold any tools that could be held by such an object. Alternatively shaped holders could also be formed for placement within holes 46 or 48. Roll holder 100 is preferably hollow throughout its length and therefore can act as a holder for narrower tools such as small hammers, pry bars, etc. Roll holder 100 can also be formed hollow from only one or both ends with a solid center section within its length. Removing roll holder 100 from base 10 allows the existing corner holes 46 and 48 to provide storage for various tools such as hammers, pry bars, etc. Roll holder 100 is preferably constructed of a light weight material such as plastic, fiberglass, or a metal alloy.

Figure 4:
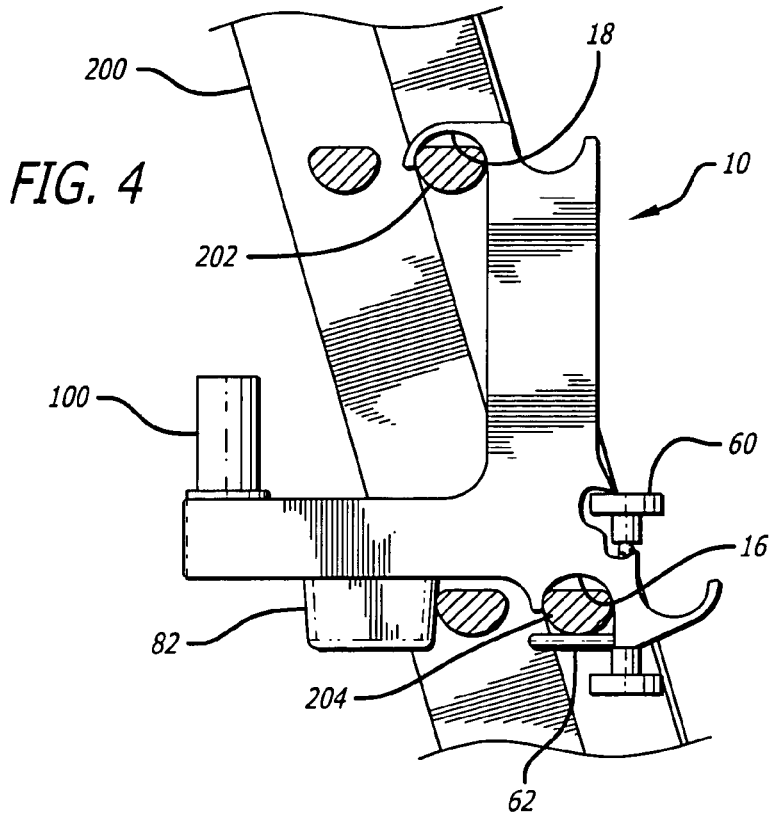
FIG. 4 shows the ladder caddy of FIG. 1 mounted to a ladder in a first position.

Winged bar 110 includes a cylindrical central section for fitting within a cradle within base 10, and includes a flat section 112 for being clamped to base 10. It can be easily removed from the base when not in use simply by loosening the clamp. Winged bar 110 further includes elongated sections 114 and 115 and rounded, bent tips 116 and 117. Sections 114 and 115 are suitable for holding coils of rope, hose, electrical cord, and the like. Upturned tips 116 and 117 help to retain the coil of cord or the like on winged bar 110. These upturned tips 116 and 117 on winged bar 110 can also hold power tools having handles with an enclosed D shape such as heavy duty power drills, reciprocating/circular saws, air nailers, and small chain saws. Sections 114 and 115 are set apart at a distance greater than the width of a ladder. Because of this, winged bar 110 can hold long lightweight tools and building materials such as dimensional lumber, conduit, tubing, piping, trim, and molding. Winged bar 110 can be positioned within a cradle of base 10 with sections 114 and 115 and the upturned tips 116 and 117 spaced equal distances from the ladder, or can be adjusted side to side within a cradle of base 10 so that one end can be closer to or farther from the ladder as needed for holding lighter weight bulky items away from the ladder or heavier items closer to the ladder. Winged bar 110 can also be moved side to side to accommodate inside structural corners of buildings where a ladder may be placed next to a perpendicular wall. A fast tightening knob 62 and clamp bar 63, which thread together, cooperate to form a clamping assembly for holding winged bar 110 securely to base 10. The knob and clamp bar may be formed with the male thread on clamp bar 63 as shown and the female thread within knob 62, or vice versa. Alternatively, other types of clamping mechanisms may be used. An identical clamping assembly which includes knob 60 and clamp bar 61 provides a clamp to positively hold base 10 to a ladder, as illustrated in FIG. 4. Winged bar 110 is preferably constructed of a strong material such as plastic, fiberglass, or a metal alloy.

Figure 3:
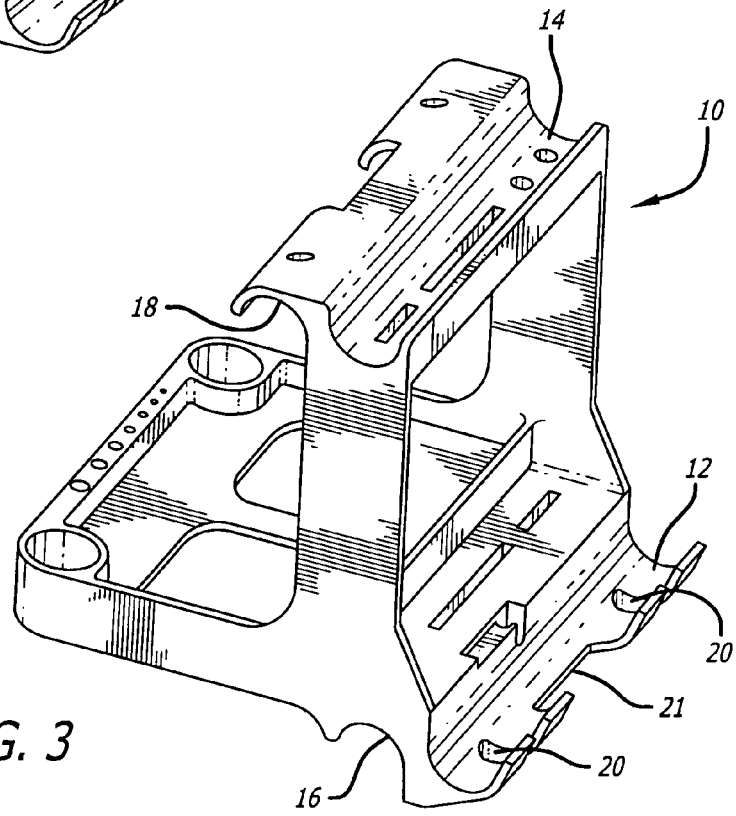
FIG. 3 is a perspective view showing the base of the ladder caddy of FIG. 1.

Turning to FIG. 2, base 10 includes a vertical frame section 30 which holds the base to the ladder, and an outwardly extending horizontal tool holding section 32. A first concave surface or feature 12 and a second concave surface or feature 14 defines a first pair of cradles for mounting the base 10 on a ladder. As can be seen in FIG. 3, third concave surface or feature 16 and fourth concave surface or feature 18 defines a second pair of cradles for mounting the base 10 to a ladder when the device is inverted and turned in a generally upside down position from the position shown in FIG. 2. Third cradle 16 includes a number of tool holding recesses including slot 50, slot 52, and holes 54. Second cradle 14 includes similar tool holding features. First cradle 12 includes a slot 20 for holding extension cords by their ends as well as other tools. Slot 20 is wide enough to allow the cord portion of the extension cord to be inserted into the slot, but narrow enough to prevent the plug end of the extension cord from falling through slot 20. This allows an unused extension cord to be hung in slot 20 without falling from the ladder. It also allows the user to place a power tool, such as a power drill, onto the base 10 while allowing the user to place the extension cord into slot 20 thus preventing the weight of the extension cord from dragging the power tool off of the tool caddy. Cradle 18 contains a similar slot for use when base 10 is being used in the inverted position. First and second mounting cradles 12 and 14 are spaced apart to accommodate the standard spacing between rungs of a ladder, which is 12 inches. Thus, the spacing between mounting cradles is preferably between 11 and 13 inches, and more preferably approximately 12 inches. The spacing between second and third mounting cradles 16 and 18 is also at 12 inches. The base 10 also includes hole 68 and docking slot 66 for conveniently and securely holding clamp bar 61 out of the way when clamp bar 61 is not in use. A similar hole and docking slot are provided for conveniently and securely holding clamp bar 63 out of the way when clamp bar 63 is not in use.

Outwardly extending horizontal tool holding portion 32 includes a generally tray like area 34 bounded by ridges 36 and boss 37. Tray area 34 includes apertures 38 and 40 for holding cups 82 and 86. Alternatively, tray area 34 can hold liner tray 90. Corner holes 46 and 48 are also provided for holding roll holder 100, or for holding other small thin tools.

Holes 42 are formed in boss section 37. Holes 42 can extend all the way through boss 37 for holding tools such as screwdrivers, awls, etc.; they can also extend only partially into boss 37 to hold items such as drill bits; or they can be a combination thereof. Holes 42 can also be of various diameters to hold large drill bits, small drill bits, chuck keys, and various other tools. The user can drill additional holes into boss 37 of various sizes and depths according to the user's needs and preferences.

FIG. 3 illustrates the base 10 inverted and turned generally upside down from its position shown in FIG. 2. In this position, mounting cradles 16 and 18 will rest upon rungs of the ladder, and cradles 12 and 14 can now serve to hold various tools and accessories such as winged bar 110, sections of piping or conduit, screwdrivers, or the like. In this position the base also contains additional holes and slots corresponding to hole 54, slot 50, slot 52, docking slot 66 and hole 68. Thin slots 50 and 52 can accommodate thin tools such as a speed square, a framing square, a tee-bevel, a tri-square, flat screwdrivers, chisels, etc. The slots can be slightly tapered so that sharp tools such as chisel points do not protrude through the openings.

FIG. 4 is a cut-away view showing the base 10 mounted on extension ladder 200. Concave cradles 16 and 18 of base 10 rest upon first and second consecutive rungs 202 and 204 of ladder. Tightening knob 60 and clamp bar 62 engaged threadingly to clamp the bar 62 to rung 204 in order to firmly hold the base 10 to the ladder.

Figure 5:
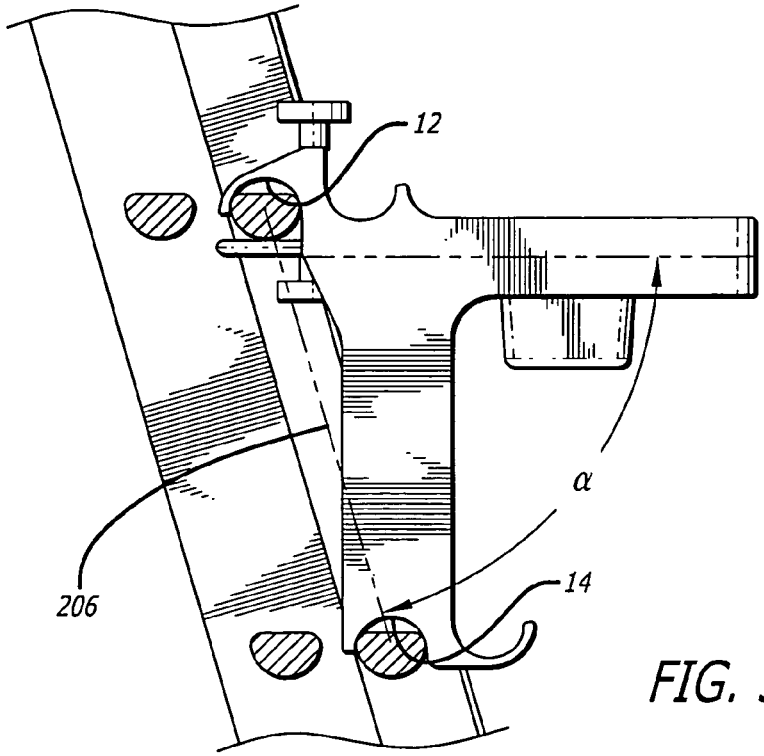
FIG. 5 shows the ladder caddy of FIG. 1 inverted and mounted to a ladder in a second position generally upside down from the first position shown in FIG. 4.

FIG. 5 shows the base 10 inverted and mounted in a position generally upside down from the position shown in FIG. 4. In this position, concave cradle areas 12 and 14 rest on consecutive rungs of the ladder.

The standard recommended lean angle of an extension ladder is 15°. Base 10 is formed so as to accommodate such an anticipated lean angle of the ladder. In particular, the angle $\alpha$ between an imaginary line 206 drawn between consecutive rungs of the ladder, the consecutive rungs defining a mounting plane, and the direction at which the base extends outwardly from the ladder, is offset from perpendicular to accommodate the expected lean angle. The offset angle is preferably between 5° and 25°, is more preferably between 10° and 20°, and is more preferably still approximately 15° to accommodate the recommended lean angle. In other words, the angle between line 206 and the generally horizontally extending tool holding section of the base is 65° to 85°, more preferably 70° to 80°, and more preferably still approximately 75°.

Figure 6:
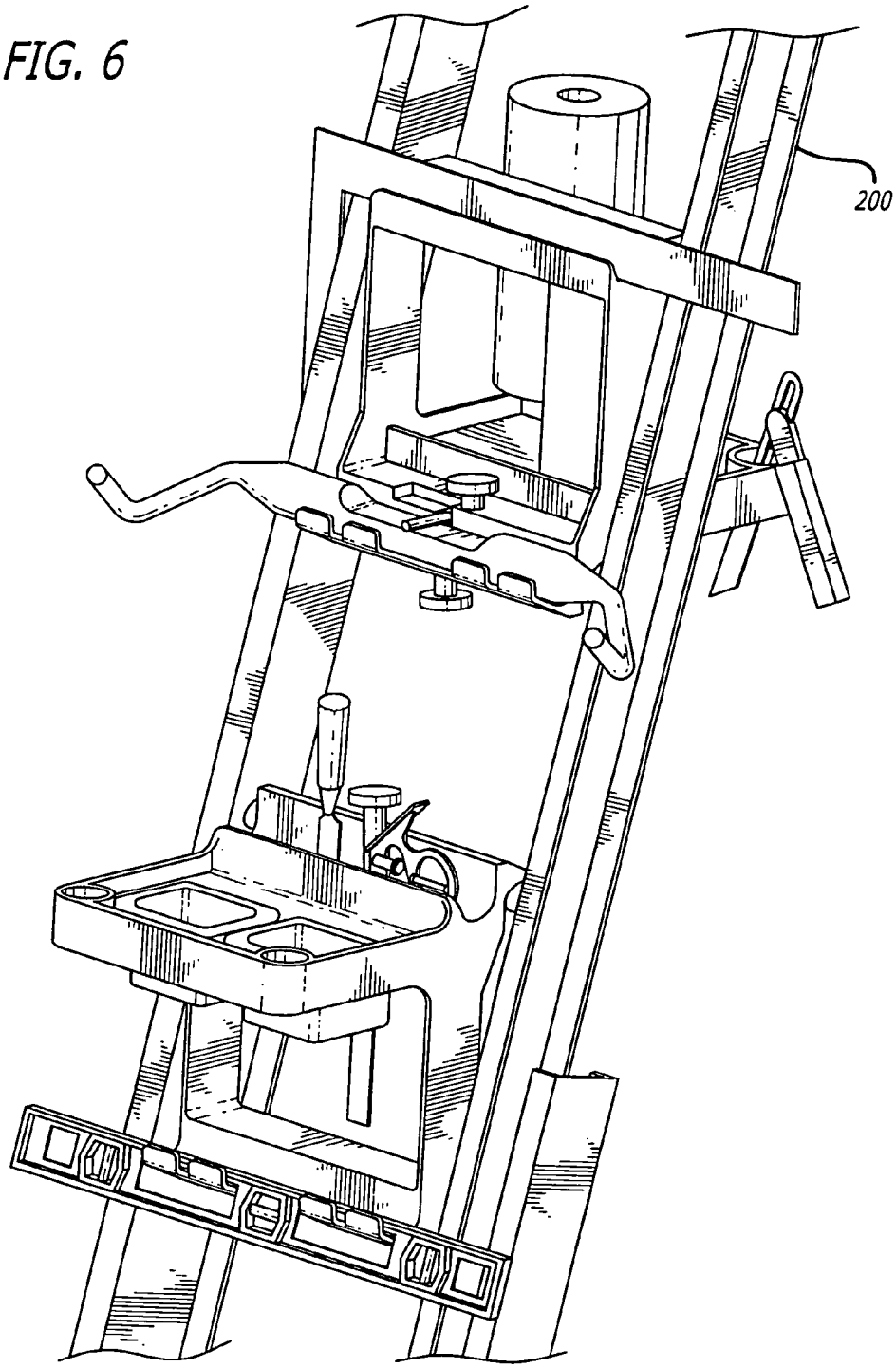
FIG. 6 is a perspective view of a ladder with the ladder caddy of FIG. 1, viewed from in front of the ladder, illustrating possible mounted positions and uses for the ladder caddy of FIG. 1 to hold tools on a ladder.

As shown in FIG. 3, cradle surface 12 also includes a central slot 21 to facilitate holding of items such as a carpenter's level. Cradle surface 18 includes an identical central slot. FIG. 6 shows a carpenter's level being held in cradle 18 and utilizing central slot 21.

Figure 7:
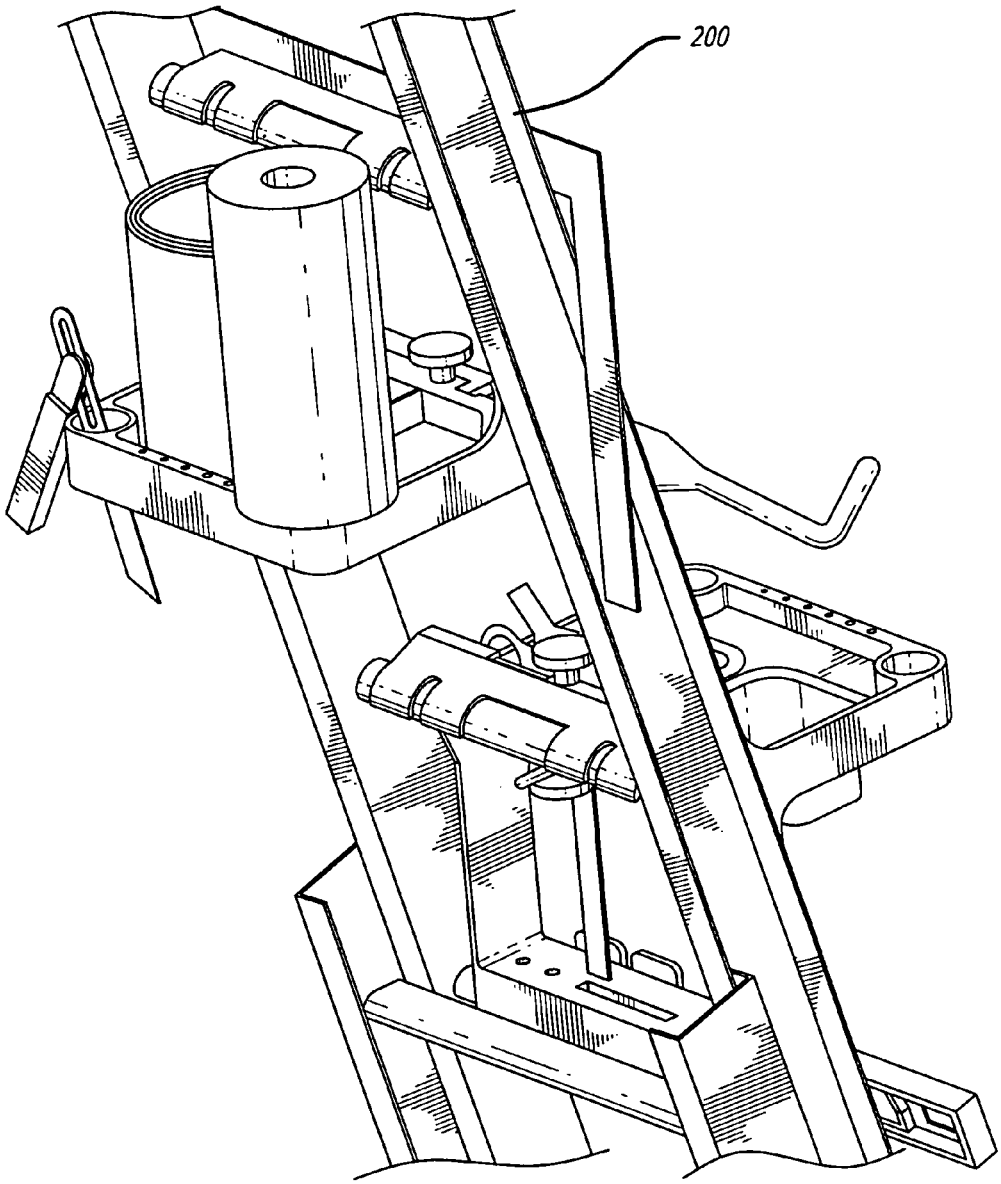
FIG. 7 is a perspective view of a ladder with the ladder caddy of FIG. 1, viewing from behind the ladder, illustrating possible mounted positions and uses for the ladder caddy of FIG. 1 to hold tools on a ladder.

FIGS. 6 and 7 show various illustrative uses of the tool caddy of the present invention to hold a number of different tools on ladder 200.

It will be appreciated that the term "present invention" as used herein should not be construed to mean that only a single invention having a single essential element or group of elements is presented. Similarly, it will also be appreciated that the term "present invention" encompasses a number of separate innovations which can each be considered separate inventions. Although the present invention has thus been described in detail with regard to the preferred embodiments and drawings thereof, it should be apparent to those skilled in the art that various adaptations and modifications of the present invention may be accomplished without departing from the spirit and the scope of the invention. For example, the base can be made from a single molded piece, or it can be made of two or more constituent parts affixed together. Various clamping mechanisms could be used. A great variety is possible regarding the number, sizes, shapes, and placement of holes, slots, cups, and holders. The surfaces which form the ladder rung cradles need not be smoothly rounded in the D-shapes shown, but could be angled to form rectangular recesses, and could be of varying depths, and could be specifically adapted for placement upon round rungs, D-rungs, flat rungs, or other shaped rungs. The base and its structural features can also take a wide variety of shapes, and could include triangular supports or webs added diagonally across the outside of the "L" surfaces for additional strength in supporting the horizontal tool holding tray area. Accordingly, it is to be understood that the detailed description and the accompanying drawings as set forth hereinabove are not intended to limit the breadth of the present invention, which should be inferred only from the following claims and their appropriately construed legal equivalents.

We claim:

1. A device for holding tools within reach of a workman on a ladder, comprising:

a holder portion for holding a plurality of tools; and first and second concave surfaces for cradling two different rungs on one side of a ladder simultaneously, thereby providing first and second points for mounting said holder to said ladder for stability;

third and fourth concave surfaces spaced apart a distance approximately equal to said spacing between consecutive rungs of said ladder;

wherein said first and second concave surfaces face in a generally upward direction, and said third and fourth concave surfaces face in a generally downward direction;

wherein said device can be mounted in a first position in which said first and second concave surfaces hold the device to the ladder, and can be mounted in a second position inverted and turned generally upside down from the first position in which said third and fourth concave surfaces hold the device to the ladder;

the device further comprising a plurality of object holding accessories for holding objects, the object holding accessories mating the holder portion for holding said objects when the device is in its first position, and also mating the holder portion for holding said objects when the device is in its second position inverted and upside down from its first position.

2. The device of claim 1 wherein the first, second, third, and fourth concaves surfaces are such that:

when the device in its first position in which the first and second concave surfaces hold the device to the ladder, the third and fourth concave surfaces can be used to hold at least one tool each; and when the device in its second position in which the third and fourth concave surfaces hold the device to the ladder, the first and second concave surfaces can be used to hold at least one tool each.

3. The device of claim 2 wherein:

at least two of said concave surfaces have additional features particularly adapted for holding tools.

4. The device of claim 3 wherein at least one of said additional features comprises a slot wide enough to hold an electrical cord but narrow enough to prevent a plug end of said electrical cord from passing through the slot.

5. The device of claim 2 further comprising a coiled cord holding accessory for holding a loop of cord or a D-handled power or air tool, wherein the cord holding accessory fits within one of said concave surfaces.

6. The device of claim 1 wherein:

at least one of said concave surfaces has at least one recess therein for holding a tool.

7. The device of claim 1 further comprising:

a plurality of interchangeable accessories for holding differently shaped objects depending on the preference of a user and a task at hand facing the user.

8. The device of claim 1 further comprising:

a clamp; and an elongated accessory suitable for holding a coiled section of cord, D-handled power or air tool, or conduit/piping and other building materials, the accessory fitting into a corresponding portion of the device and capable of being clamped thereto by said clamp.

9. A device for holding tools within reach of a workman on a ladder, comprising:

a holder portion for holding a plurality of tools, the holder including a plurality of differently shaped recesses for holding a plurality of different tools; and first and second concave surfaces for cradling two different rungs on one side of a ladder simultaneously, thereby providing first and second points for mounting said holder to said ladder for stability;

wherein at least one of said recesses is a generally cylindrical recess, and wherein the device further comprises:

a roll holder accessory adapted for being held within said generally cylindrical recess, said roll holder accessory having an elongated portion adapted for holding a roll of paper towels, masking paper, rolls of tape, or narrow small tools.

10. A device for holding tools within reach of a workman on a ladder, comprising:

a holder portion for holding a plurality of tools; and first and second concave surfaces for cradling two different rungs on one side of a ladder simultaneously, thereby providing first and second points for mounting said holder to said ladder for stability:

at least one clamp for clamping at least one of said concave surfaces to at least one rung of said ladder, said clamp comprising an angled rod, the angled rod capable of rotating and fitting into a recess within the device when the clamp is not being used.

11. The device of claim 10 wherein said clamp further includes a tightening knob, the knob and the angled rod mutually threadingly engaging each other such that a user can tighten or loosen the clamp by turning the knob.

* * * * *